US006206375B1

(12) United States Patent
Wichinsky

(10) Patent No.: US 6,206,375 B1
(45) Date of Patent: Mar. 27, 2001

(54) BLACKJACK TABLE CARD GAME AND METHOD THEREFOR

(76) Inventor: Michael Wichinsky, 711 Lacy La., Las Vegas, NV (US) 89107

( * ) Notice: Under 35 U.S.C. 154(b), the term of this patent shall be extended for 0 days.

(21) Appl. No.: 09/389,604

(22) Filed: Sep. 3, 1999

(51) Int. Cl.[7] ..... A63F 1/00
(52) U.S. Cl. ..... 273/292; 273/274
(58) Field of Search ..... 273/292, 274, 273/309, 138 R

(56) References Cited

U.S. PATENT DOCUMENTS

| | | | | |
|---|---|---|---|---|
| 5,174,579 | * | 12/1992 | Griffiths | 273/292 |
| 5,275,416 | * | 1/1994 | Schorr et al. | 273/292 |
| 5,454,570 | * | 10/1995 | Karal | 273/292 |
| 5,549,300 | * | 8/1996 | Sardarian | 273/292 |
| 5,639,092 | * | 6/1997 | Macaisa | 273/292 |
| 5,816,575 | * | 10/1998 | Keller | 273/292 |
| 5,979,897 | * | 11/1999 | Grossman | 273/292 |
| 6,062,564 | * | 5/2000 | Terminel | 273/292 |
| 6,070,875 | * | 8/2000 | Boylan et al. | 273/292 |
| 6,079,712 | * | 6/2000 | Eaton et al. | 273/274 |
| 6,095,525 | * | 8/2000 | Terminel | 273/274 |

* cited by examiner

*Primary Examiner*—Jeanette Chapman
*Assistant Examiner*—Dolores R. Collins
(74) *Attorney, Agent, or Firm*—Jeffrey Weiss; Jeffrey D. Moy; Wiess & Moy, P.C.

(57) ABSTRACT

A blackjack table card game and method is disclosed which permits each player betting against a dealer several betting options by placing one or more chips in one or more separate betting regions located in front of each player. One of these betting regions permits a player to bet that the player will receive a two-card blackjack consisting of one card having a value of nine, ten, eleven or twelve and the other card having a corresponding respective value of twelve, eleven, ten or nine in any two card sequence. Preferably 60 playing cards are used consisting of a standard deck of 52 playing cards and eight additional playing cards which consist of four different suited playing cards each having a value of 11 and four different playing cards each having a value of 12.

20 Claims, 1 Drawing Sheet

BLACKJACK TABLE CARD GAME AND METHOD THEREFOR

FIELD OF THE INVENTION

This invention generally relates to card games and methods therefor and, more particularly, to an improved Blackjack table card game and method therefor.

BACKGROUND OF THE PRIOR ART

In the past, various card games have been developed for social and gambling or gaming type uses. A very popular card game, especially for gambling or gaming uses is the card game known as Blackjack (or "21") wherein a blackjack player plays against a Dealer and the object is to beat the Dealer by either "Standing" or "Sticking" (not drawing a card that might cause the Blackjack player to "Bust" (go over 21) and hope that the Dealer will "Bust") or by receiving a cumulative point card total higher than the Dealer from the Blackjack player's received playing cards being as close to 21 as possible with 21 being the maximum permissible score. In other words, if the Blackjack player and Dealer each achieve a total not exceeding 21, then the highest total wins the bet. Blackjack is relatively simple to understand and is usually a faster and easier card game to play than, for example, the game of Poker, therefore, Blackjack, which can be played with the Dealer and only one Blackjack player, is, in most Casinos, even more popular than the conventional game of Poker which needs to be played with several players because each of the Poker players are competing against each other for one "pot" whereas each Blackjack player can win against the one Dealer. Thus, this game includes a Dealer and at least one Blackjack player. One or more Blackjack players playing against the Dealer are, in effect, individually competing to try to either obtain a better card score (for multiple playing cards that they are dealt) than the Dealer or to "Stick" or "Stand" after receiving a minimum of 2 cards and hope that the Dealer will "Bust". For example, Blackjack players seeing one of the two Dealer's initial cards which is turned up may decide not to draw any additional card because they will win the bet if the Dealer has to hit (the Dealer is required to draw if their point total is 16 or less) and the Dealer "Busts" (goes over 21). A Blackjack player receiving a card score of more than 21 points has the so called "Bust" hand and automatically loses to the Dealer (and vice versa). The Dealer, after receiving the first 2 cards begins drawing one or more cards (if the first 2 cards are 16 or less), but only after each of the Blackjack players at the Dealer's table have completely played their hand. Therefore, the "House" or Casino has the advantage because the Blackjack player or players must play and complete their hand first or before the Dealer. The Blackjack players at the table individually playing against the Dealer and also the Dealer must receive a minimum of 2 cards. Each of the Blackjack players individually playing against the Dealer (who is representative of the "House" or Casino) have the option of "Sticking" after the receipt of their 2 initial cards which means that they will not receive any other cards or to draw one or more other cards from the Dealer and to continue until they are either satisfied with their card count score and stop drawing cards ("Sticking") or they have "Busted" (gone over the 21 point total). As is known in the Blackjack card game, picture cards (Jacks, Queens and Kings) each have a point card value of 10 points while Aces have a point card value of either 1 point or 11 points. The other cards namely 2s, 3s, 4s, 5s, 6s, 7s, 8s, 9s, and 10s have a point card value equivalent to their face card value (i.e. respectively 2, 3, 4, 5, 6, 7, 8, 9, and 10). In virtually all gaming or Casino establishments, Dealers have to draw when they receive a point card value of 16 or less and, in some Casinos or gaming establishments, when they receive a point card value of 17 or less where the 17 point card value is based upon using an Ace as an 11 point card value with one or more other cards (this is known as a "Soft 17").

While the conventional game of Blackjack or 21 is a relatively fast card game, this conventional game is not very dynamic and becomes very very boring when played for an extended period of time. For example, many Blackjack players are finding the conventional game of 21 very boring because they don't have any significant betting options because of the manner that 21 is now being played. Because of the small percentage difference in the odds of playing Blackjack against a Dealer (with only a few percentage points in favor of the Dealer (or the House)), the same (gaming) chip or chips are often passed from the Blackjack player to the Dealer (when the Blackjack player loses) and from the Dealer to the Blackjack player (when the Dealer loses to the Blackjack player). This passing chips back and forth routine will sometimes last for relatively long periods of time until either the Blackjack player starts losing more often than winning because of a streak of bad luck or because of the percentage of odds in favor of the Dealer (or the House) or because the Blackjack player receives a run of good luck and wins more hands against the Dealer over a somewhat limited period of time. Blackjack players faced with losing several bets in a row will often become upset and will seek to recoup their losses quickly by significantly increasing the amount of their bet. This often results in the Blackjack player losing even greater amounts of money and at a faster rate of loss.

As a result, the present conventional game of Blackjack, as it is presently played, is tedious (because there is usually only one betting option—to beat the Dealer by either receiving a higher point score or to hope that the Dealer will "Bust") and does not generate much excitement or enthusiasm for the Blackjack player. Other betting options are needed to create more interest for the Blackjack player other than to significantly increase the bet. Thus an improved Blackjack game is needed which would permit each Blackjack player to bet a relatively small amount of money and have a chance to win a relatively large amount of money (as an option after losing a number of conventional bets to the Dealer) without the risk of losing a large bet that was the only previous option to try to promptly recoup a series of lost bets to the Dealer.

Attempts have been made to vary the game of Blackjack to a relatively minor degree wherein a Blackjack player could have more than one betting option (other than the Blackjack player's bet to receive a higher card total (not more than the maximum of 21) than the Dealer or to hope the Dealer "Busts). However, a number of these other attempts have not been successful because they do not provide a multitude of vary exciting betting options combined with a large multiple type of payout. U.S. Pat. No. 5,454,570 to Karal discloses a Blackjack card game method wherein a Blackjack player has extended wagering opportunities after the Blackjack player's hand has reached a desired card count value. Specifically, the Blackjack player can bet on whether the Dealer will achieve a card count that would be higher (but not greater than 21) than the Blackjack player's hand. This supplemental bet or wager by the Blackjack player is prior to the Dealer revealing the Dealer's face down card. Predetermined odds on the different possible Dealer hand combinations are selected by the Blackjack player by the selection of the point card value of the Dealer's hand. Also, the Blackjack player can wager on the point card value of the Dealer's only face down card. Furthermore, the Blackjack player can bet on the point card value of the third Dealer card, etc. The odds presented in this U.S. Patent range from 10 to 1 (on an Ace being the Dealer down card or the next card to be drawn by the Dealer). Picture card including 10s have a 2 to 1 betting ratio.

U.S. Pat. No. 5,275,416 to Schorr et al. also discloses a Blackjack card game method wherein a Blackjack player can bet on the Dealer's hand, the Blackjack player's hand or for a tie in the point count between the Dealer and the Blackjack player. The bet for the tie pays 9 to 1, the bet for the Blackjack player's hand is even money (1 for 1), and the bet on the Dealer's hand is 5 for 6 (five chips can be won on a 6 chip bet).

U.S. Pat. No. 5,174,579 to Griffiths discloses a Blackjack card game method wherein a separate bet can be made on whether the Dealer obtains exactly 21 or Busts. Disclosed therein is a discussion of Royal Match 21 involving a separate bet by the Blackjack player to have their 2 initial cards be of the same suit (i.e. clubs, diamonds, hearts and spades). A higher payout is for when the Ace and King is received by the Blackjack player in the same suit for the 2 initial cards, but there is no separate bet for the receipt of these two cards (only a payout if they happen to be received when a bet is made for the receipt of 2 initial cards of the same suit). Also disclosed therein is a reference to the U.S. Pat. No. 4,861,041 to Jones et al. wherein a separate bet is made to be eligible for certain specific jackpot hands (i.e. four 5s and an Ace or Ace, Two, Three, Four, Five and Six).

U.S. Pat. No. 5,816,575 to Keller discloses a Blackjack card game wherein various bets can be made by a player obtaining certain cards with a large jackpot amount available if a player bets for and obtains a Blackjack consisting of an Ace or Spades and a Jack of Spades (or alternatively, a player can receive the same large jackpot amount if the player bets for and obtains a Blackjack consisting of an Ace of Clubs and a Jack of Clubs).

All of the above identified U.S. Patents disclose various Blackjack games which use a standard 52 card playing deck of cards. Thus, there is only a limited amount of opportunities for a player to achieve the ultimate hand which is to receive a two card "21" or Blackjack on the initial first two cards received by the player. Furthermore, there isn't much excitement for a player to play the same game of Blackjack with the same standard deck of 52 playing cards (or with a shoe of 4 or 6 decks of the standard 52 playing cards).

Accordingly, a need existed for providing a new, exciting Blackjack card game and method that would provide multiple betting options for a player beside the standard betting option to beat the Dealer and that would use a deck of playing cards containing more than the conventional 52 playing cards to provide the player with a greater number of possibilities to obtain a Blackjack ("21" point card value) on the player's initially received two playing cards. Thus, there is a need for a dynamic Blackjack game which would preferably use additional unique playing cards (60 total cards) that would provide a Blackjack player with four general type betting options (1) a side bet to gamble on receiving an initial two cards that would pay the player a relatively large amount for receiving one Ace and another card having a value of ten (either a 10 or a picture card) thereby providing a "natural" Blackjack, (2) a side bet to gamble on receiving an initial two cards having a cumulative point value of "21" using, in combination, a 9, 10, 11 or 12 as a first card and a second card respectively being a 12, 11, 10 or 9 thereby providing a two initial card combination of "21", (3) a side bet to gamble on the player receiving any number of cards (2 or more cards) totaling exactly 21, and (4) a regular bet for a player to beat the Dealer regardless of the number of cards received by the player or the Dealer.

SUMMARY OF THE INVENTION

It is an object of this invention to provide an improved Blackjack table card game and method.

It is a further object of this invention to provide an improved Blackjack table card game and method that provides a Blackjack player with multiple betting options.

It is a still further object of this invention to provide an improved Blackjack table card game and method that provides a Blackjack player with multiple side betting options with each side betting option providing a payback of more than a conventional one for one payback that a player would receive in a conventional Blackjack game.

It is still another object of this invention to provide an improved Blackjack table card game and method that provides a Blackjack player with multiple side betting options with each side betting option providing a payback, depending on the side betting option selected and bet on, of at least 10 times the amount bet by the Blackjack player.

BRIEF DESCRIPTION OF THE PREFERRED EMBODIMENTS

In accordance with one embodiment of this invention, a blackjack table card game is provided which comprises, in combination: a table for use in playing a blackjack card game; and a plurality of betting areas located on the table for each player, one of the plurality of betting areas is to bet that the player will receive a two-card blackjack consisting of one card having a value of nine, ten, eleven or twelve and the other card having a corresponding respective value of twelve, eleven, ten or nine in any initial two card sequence.

In accordance with another embodiment of this invention, a method of playing a card game of blackjack is disclosed which comprises, the steps of: providing a table for use in playing a blackjack card game; and providing a plurality of betting areas located on the table for each player which includes providing one of the plurality of betting areas to bet that the player will receive a two-card blackjack consisting of one card having a value of nine, ten, eleven or twelve and the other card having a corresponding respective value of twelve, eleven, ten or nine in any initial two card sequence.

The foregoing and other objects, features and advantages of this invention will be apparent from the following more particular description of the preferred embodiments of the invention as illustrated in the accompanying drawings.

BRIEF DESCRIPTION OF THE DRAWING

The sole FIGURE is a top view of a player's betting palette 6 equivalent betting palettes are shown for six players located on a table (around an outer perimeter portion thereof) of the Blackjack table game of this invention and using the method of this invention.

DESCRIPTION OF THE SPECIFICATION

Figure 1:
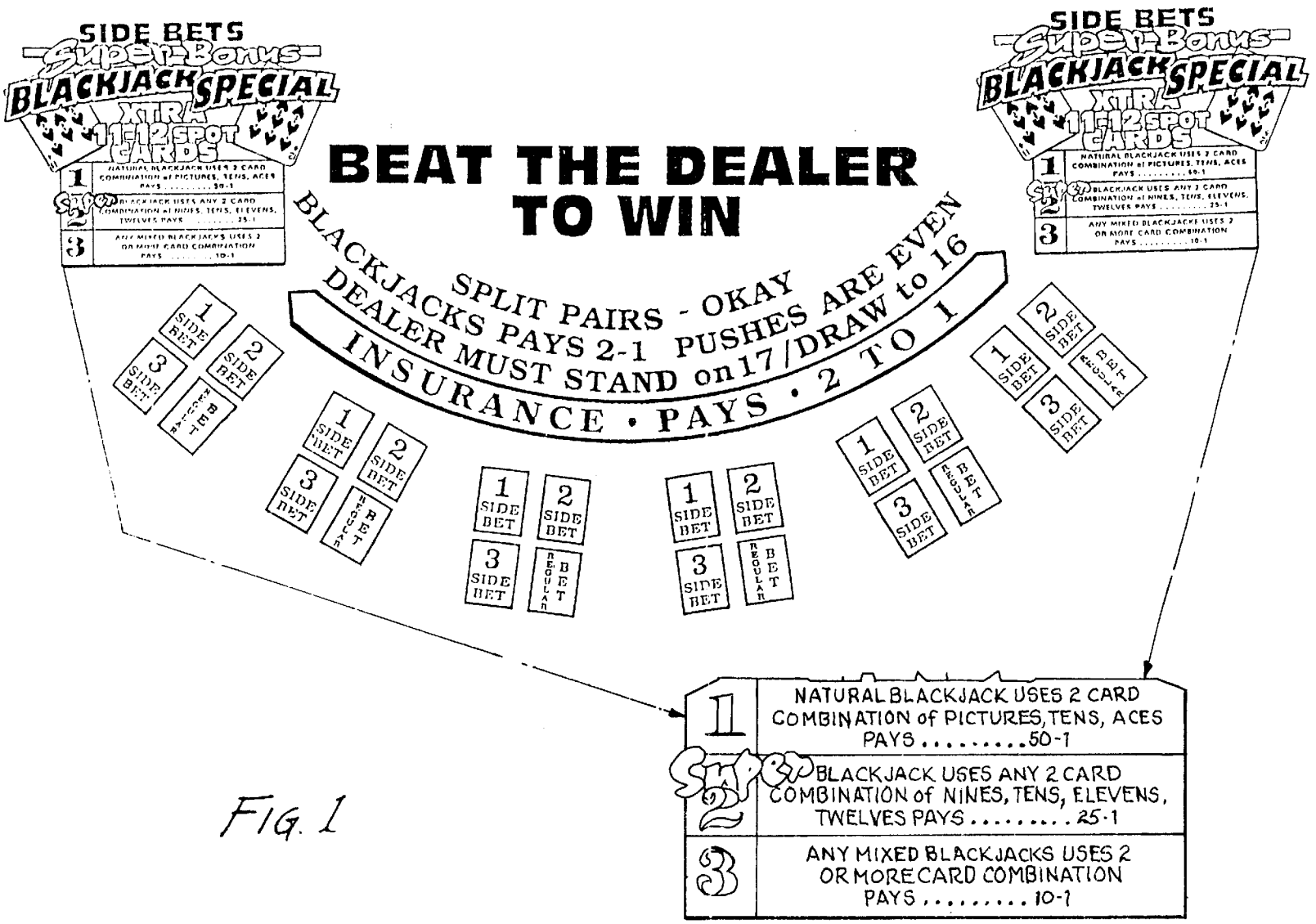

Referring to the sole FIGURE, a player's betting palette (6 equivalent betting palettes are show for use by six players) is shown located on a surface of a Blackjack table game. As shown in the sole FIGURE, the 6 equivalent betting palettes are shown located around the outer perimeter portion of the table adjacent to where six players would be seated (not shown). If desired, the number of betting palettes (equal to the number of players) can be varied depending upon the size of the table or the desirability of the casino operator. Each player's betting palette shown in the sole FIGURE comprises a number of different betting options for a Blackjack player.

Each of the player's betting palettes consists of four separate betting options as shown in the sole FIGURE. As briefly described in the upper right and upper left portion of the table depicted in the sole FIGURE, three side betting options respectively designated by numbers 1, 2 and 3 are available to each player. The numbers 1, 2 and 3 that are noted in the upper right and left portions of the Blackjack table illustrated in the sole FIGURE correspond to the side bet numbers 1, 2 and 3 illustrated in three separate side bet regions or areas shown as substantially rectangular shaped separate regions that would be located in front of each player. A number 4 designated region also shown as a rectangular betting region is also located in front of each player. Each of these four separate betting regions is described below.

Referring to the betting region in front of each player designated as "1 side bet", this betting region is provided to permit a player to place a bet therein of one or more chips (each chip has a designated dollar value i.e. a five dollar chip, a twenty-five dollar chip, a one hundred dollar chip, etc.). By placing a bet in the "1 side bet" designated area, a player is gambling on receiving an initial two cards from the Dealer that would give the player a "natural" Blackjack which is a combination of either a 10, Jack, Queen or King (each of these cards have a value of 10) with an Ace (which in this situation has a value of 11) thereby providing the player with a "21" or "natural" Blackjack. In this example of a "natural" Blackjack, the player placing a bet in the "1 side bet" region will receive a payout by the Dealer (regardless if the first card (of the initial two cards received by the player) or the second card is an Ace or a card having a value of 10). The payout for this side bet option can be any amount set by the casino and approved by an appropriate gaming authority. For example, the proposed payout amount shown in the upper right and left portions of the sole FIGURE is 50 to 1 which means that a player betting $10 will receive a payback of $500 for this particular bet and the receipt of the "natural" Blackjack.

Referring to the betting region in front of each player designated as "2 side bet", this betting region in front of each player is provided to permit a player to place a bet (of one or more chips) in the "2 side bet" region. Thus, by placing a bet in the "2 side bet" region or area, a player is gambling on receiving an initial two cards from the Dealer that would give the player a two-card blackjack consisting of one card (of the initial two cards) having a value of nine, ten, eleven or twelve and the other card of the initial two cards having a corresponding respective value of twelve, eleven, ten or nine (in any initial two cards sequence). This very exciting new two "21" or Blackjack combination is only made possible because of the use of a unique deck of 60 playing cards that is used for the blackjack table card game and method of this invention. This unique deck of 60 playing cards consists of 52 standard or conventional playing cards combined with eight additional playing cards. These eight additional playing cards consists of four different suited playing cards each having a value of 11 and another four different suited playing cards each having a value of 12. The four suits used for each of the four 11 card values and the four suits used for each of the four 12 card values are the conventional suits of clubs, diamonds, hearts and spades. Preferably, the number 11 is used in the upper left corner and the bottom right corner of each of the four 11 valued cards and, correspondingly, the number 12 is used in the upper left corner and bottom right corner of each of the four valued 12 cards. Like the conventional "10" card, each 11 valued card and each 12 valued card each having corresponding 11 or 12 (club, heart, diamond or spade) designs on one side thereof. Now, with this unique deck of 60 playing cards, a player can receive (and bet for receiving) any two card combination of "21" by either receiving 9 and a 12 (one possible combination) or vice versa, and a 10 and an 11 (a second possible (natural) combination) or vice versa. Thus, considering all possible two card "21" combinations for the two initial cards, there are now four different combinations (versus the prior only two different combinations) to achieve a "21" in two cards (i.e. 9 for the first card and 12 for the second card, 12 for the first card and 9 for the second card, a value of 10 for the first card (either a 10, Jack, Queen or King) and an Ace for the second card, and an Ace for the first card and a 10 for the second card (either a 10, Jack, Queen and King)). These additional combinations makes this "2 side bet" betting option very exciting for a player.

Referring to the "3 side bet", this betting option permits a player to place one or more chips in this "3 side bet" designated area to permit a player to bet on receiving a total number of cards (without going over or "busting") exactly equal to 21 points whether based on the total point count of the initial two cards received by the player or for any amount of cards received by the player in the same hand.

Referring to "regular bet", this betting option is the standard bet for a player to beat the Dealer regardless of the amount of cards received by the player or the dealer (as long as the player does not go over 21 in total point count). If the player sticks with a certain count of 21 or less and the Dealer "busts" or goes over 21 in the total point count for the Dealer's cards, then the player wins.

The odds shown as examples only for the different betting regions (i.e. 50 to 1 for the "1 side bet", 25 to 1 for the "2 side bet", 10 to 1 for the "3 side bet") and, of course, a straight 1 to 1 or even bet for the regular bet region. These odds can be varied as desired or as permitted by an appropriate gaming authority for where the game of this invention is played.

The blackjack game disclosed in this patent application can be played on a gaming machine such as a video machine or in any gaming environment. Therefore, the term "table" as used in the claims is intended to encompass any video game or other card game which uses the unique blackjack game of this invention.

While the invention has been particularly shown and described with reference to the preferred embodiments thereof, it will be understood by those skilled in the art that the foregoing and other changes in form and details may be made therein without departing from the spirit and scope of the invention.

What is claimed is:

1. A blackjack table card game comprising, in combination:

a table for use in playing a blackjack card game; and a plurality of betting areas located on said table for each player, one of said plurality of betting areas is to bet that the player will receive a two-card blackjack consisting of one card having a value of nine, ten, eleven or twelve and the other card having a corresponding respective value of twelve, eleven, ten or nine in any initial two card sequence.

2. The blackjack table card game of claim 1 further comprising another of said plurality of betting areas is for betting that the player will receive a natural two-card blackjack consisting of one card having a value of ten and an Ace for the other card in any initial two card sequence.

3. The blackjack table card game of claim 1 further comprising another of said plurality of betting areas is for betting that the player will receive a total card value of 21 for the total of cards dealt to the player in one hand.

4. The blackjack table card game of claim 3 wherein the total of cards dealt to the player in one hand is two cards.

5. The blackjack table card game of claim 3 wherein the total of cards dealt to the player in one hand is greater than two cards.

6. The blackjack table card game of claim 1 further comprising another of said plurality of betting areas is for betting that the player will receive a total number of cards in one hand that will have a total card value greater than the total card value of the cards dealt to the dealer.

7. The blackjack table card game of claim 1 wherein a deck of playing cards is used having a total of 60 playing cards.

8. The blackjack table card game of claim 7 wherein 52 of the 60 playing cards are the playing cards of a standard 52 card deck of playing cards and eight additional playing cards consist of four different suited playing cards each having a value of 11 and four different suited playing cards each having a value of 12.

9. The blackjack table card game of claim 8 wherein the different suited playing cards are clubs, diamonds, hearts and spades.

10. The blackjack table card game of claim 1 further comprising another of plurality of betting areas is for betting that the player will receive a natural two-card blackjack consisting of one card having a value of ten and an Ace for the other card in any initial two card sequence, another of said plurality of betting areas is for betting that the player will receive a total card value of 21 for the total of cards dealt to the player in one hand, and another of said plurality of betting areas is for betting that the player will receive a total number of cards in one hand that will have a total card value greater than the total card value of the cards dealt to the dealer.

11. A method of playing a card game of blackjack comprising, the steps of:

providing a table for use in playing a blackjack card game; and providing a plurality of betting areas located on said table for each player which includes providing one of said plurality of betting areas to bet that the player will receive a two-card blackjack consisting of one card having a value of nine, ten, eleven or twelve and the other card having a corresponding respective value of twelve, eleven, ten or nine in any initial two card sequence.

12. The method of claim 11 further comprising providing another of said plurality of betting areas for betting that the player will receive a natural two-card blackjack consisting of one card having a value of ten and an Ace for the other card in any initial two card sequence.

13. The method of claim 11 further comprising providing another of said plurality of betting areas for betting that the player will receive a total card value of 21 for the total of cards dealt to the player in one hand.

14. The method of claim 13 wherein the total of cards dealt to the player in one hand is two cards.

15. The method of claim 13 wherein the total of cards dealt to the player in one hand is greater than two cards.

16. The method of claim 11 further comprising providing another of said plurality of betting areas for betting that the player will receive a total number of cards in one hand that will have a total card value greater than the total card value of the cards dealt to the dealer.

17. The method of claim 11 including providing a deck of playing cards having a total of 60 playing cards.

18. The method of claim 17 wherein 52 of the 60 playing cards are the playing cards of a standard 52 card deck of playing cards and eight additional playing cards consist of four different suited playing cards each having a value of 11 and four different suited playing cards each having a value of 12.

19. The method of claim 18 wherein the different suited playing cards are clubs, diamonds, hearts and spades.

20. The method of claim 11 further comprising providing another of said plurality of betting areas for betting that the player will receive a natural two-card blackjack consisting of one card having a value of ten and an Ace for the other card in any initial two card sequence, providing another of said plurality of betting areas for betting that the player will receive a total card value of 21 for the total of cards dealt to the player in one hand, and providing another of said plurality of betting areas for betting that the player will receive a total number of cards in one hand that will have a total card value greater than the total card value of the cards dealt to the dealer.

* * * * *